United States Patent [19]

Bloom et al.

[11] Patent Number: 4,529,176

[45] Date of Patent: Jul. 16, 1985

[54] REPLACEABLE SEALS FOR LADLE HEATERS

[75] Inventors: William M. Bloom, Pittsburgh; John F. Deringer, Oakmont; Robert J. Hall, Lower Burrell, all of Pa.

[73] Assignee: Allegheny Ludlum Steel Corporation, Pittsburgh, Pa.

[21] Appl. No.: 544,753

[22] Filed: Oct. 24, 1983

[51] Int. Cl.[3] ..... F27B 14/14

[52] U.S. Cl. ..... 266/242; 266/280; 266/283

[58] Field of Search ..... 266/242, 280, 901, 44, 266/281, 282, 283, 286, 285; 432/224, 225, 250

[56] References Cited

U.S. PATENT DOCUMENTS

| | | | |
|---|---|---|---|
| 4,120,641 | 10/1978 | Myles | 266/280 |
| 4,229,211 | 10/1980 | Battles | 266/901 |
| 4,287,839 | 9/1918 | Severin et al. | 266/286 |
| 4,359,209 | 11/1982 | Johns | 266/901 |

*Primary Examiner*—Peter K. Skiff
*Assistant Examiner*—S. Kastler
*Attorney, Agent, or Firm*—Patrick J. Viccaro

[57] ABSTRACT

Ladles and the like into which hot metal is teemed are refractory lined to withstand the high-temperature effects of the hot metal. Prior to teeming of the hot metal into the ladle, the ladle is heated by applying a flame to the interior thereof, which flame is provided by a burner that directs the flame through a ladle cover plate having a substantially flat surface covered with heat-insulating refractory material, which surface is brought into sealing engagement with the ladle. This seal minimizes the amount of heat energy that escapes from the ladle to render the preheating operation more efficient. The rim of the ladle, which contacts in sealing engagement the heat-insulating refractory material of the ladle cover plate, causes wear and damage to the heat-insulating refractory material. Deposits of slag and metal build up along the rim of the ladle and this further contributes to the wear and damage to the heat-insulating refractory material when the ladle cover plate is brought into sealing engagement with the rim of the ladle. The present invention provides a ladle cover plate having a ring of refractory modules that are individually, removably secured to the surface of the ladle cover plate which ring mates with the ladle rim when the ladle cover plate is brought into sealing engagement therewith. Consequently, when excessive wear or damage occurs the modules may be removed and replaced in an efficient and economical manner.

5 Claims, 8 Drawing Figures

REPLACEABLE SEALS FOR LADLE HEATERS

In the refining of various metals and alloys, including steel, molten metal is teemed from the furnace after refining into ladles. The ladles are used to carry the metal to the casting operation. The metal from the ladle is typically poured into individual molds or introduced to a continuous casting apparatus. The ladles are lined with refractory material to render them resistant to the high-temperature effects of the molten metal contained therein.

Prior to introducing molten metal to the ladle, it is customary practice to heat the ladle interior. Heating of the ladle interior is also performed after repair or relining of the ladle to dry-out the refractory repair materials. Heating of the ladle prior to introduction of the molten metal thereto avoids solidification of the metal on contact with the ladle interior surface, avoids thermal shock to the refractory interior of the ladle, which may result in cracking and deterioration of the refractory, and minimizes heat loss from the molten metal during for example transport from the furnace to the casting operation. It is a typical practice to heat ladles of this type prior to the introduction of molten metal thereto by directing a natural gas flame into the open chamber of the ladle. To render this operation more efficient by minimizing the escape of heat energy it is common practice to provide a ladle cover plate that has a substantially flat surface which is covered with heat insulating refractory material. This flat surface is brought into sealing engagement with the ladle rim and seals the ladle opening while the natural gas flame is introduced to the ladle interior by a burner that is directed into the ladle through the ladle cover plate by means of a suitable opening therein. In combination with apparatus of this type, it is known, as shown in U.S. Pat. No. 4,229,211, to use a heat exchanger wherein air is directed through the heat exchanger and through the ladle cover plate and mixed with a fuel to form the required flame in the ladle chamber. The gases from the flame are exhausted back through the ladle cover plate and through the heat exchanger. The heat in the exhaust gases is partially recuperated in the heat exchanger by being transferred to the incoming air. There is a suitable opening in the ladle cover plate through which the exhaust gases are directed, which opening may be substantially concentric with the ladle rim. This apparatus is described in more detail in the aforementioned U.S. Pat. No. 4,229,211.

The ladle cover plate has typically a network of refractory fiber modules formed from a web of refractory fibers with the modules being arranged in a common plane with the folds of each module arranged at a right angle with the folds of the adjacent modules. When these modules are brought into sealing engagement with the ladle rim they conform to the shape of the rim to form the required seal with the rim. The flexible property of the refractory fiber modules permits them to correspond to irregularities on the rim of the ladle, such as deposits of slag and metal, to insure the required seal even in the presence of such deposits. The modules are secured to the ladle cover plate surface typically by means of support rods that extend within the modules and connecting tabs that extend from the support rods which tabs may be bent for insertion within brackets that are connected to the surface of the ladle cover plate.

Upon the completion of the heating operation and when the ladle cover plate is removed from sealing engagement with the rim of the ladle the deposits of slag and solidified metal on the rim, which deposits may be of sharp, irregular configuration, will cause portions of the modules to be pulled away from the ladle cover plate surface because of the nesting or packed arrangement of the modules on the cover plate surface wherein each module is maintained in compression resulting from abuttment with adjacent modules. It is time consuming and expensive to replace damaged modules. In all instances it is necessary incident to repair of a module to remove adjacent modules which may be undamaged.

It is accordingly a primary object of the present invention to provide a ladle cover plate having a surface covered with heat insulating refractory material wherein the portion of the heat-insulating refractory material brought into sealing engagement with the ladle rim may be readily replaced in the presence of wear or damage without disturbing the remainder of the heat insulating refractory material of the ladle cover plate.

This and other objects of the invention, as well as a more complete understanding thereof, may be obtained from the following description and drawings, in which.

Figure 4:
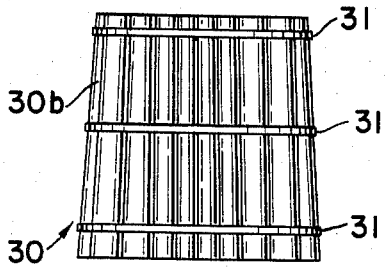
FIG. 4 is a detailed plan view of a module used in association with the ladle cover plate of the invention.
Figure 5:
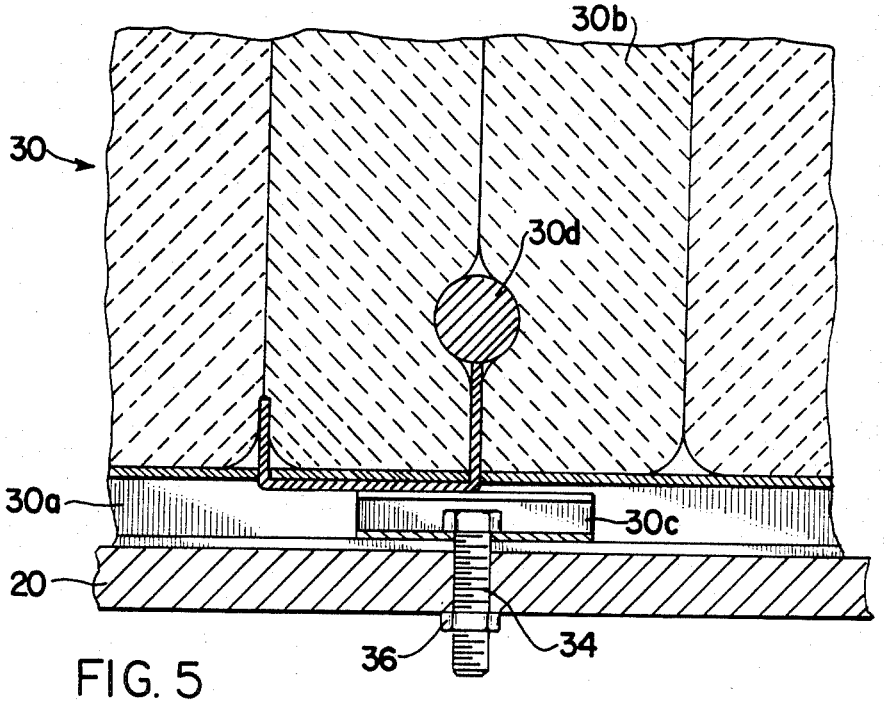
Figure 5A:
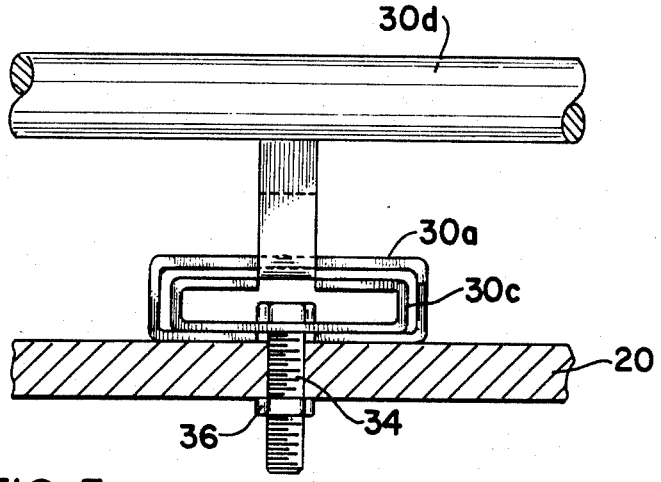
Figure 6:
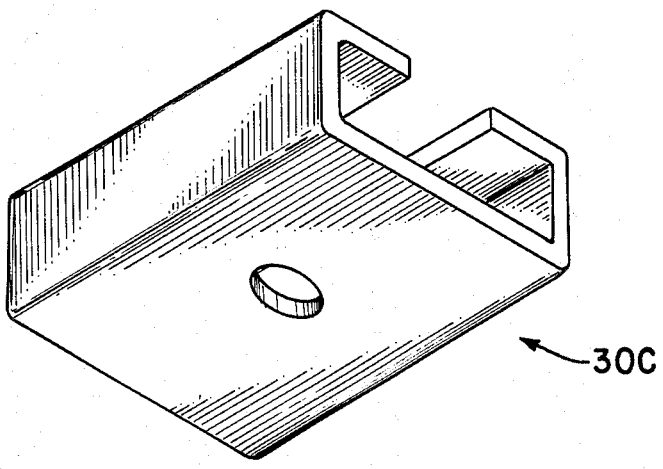
Figure 7:
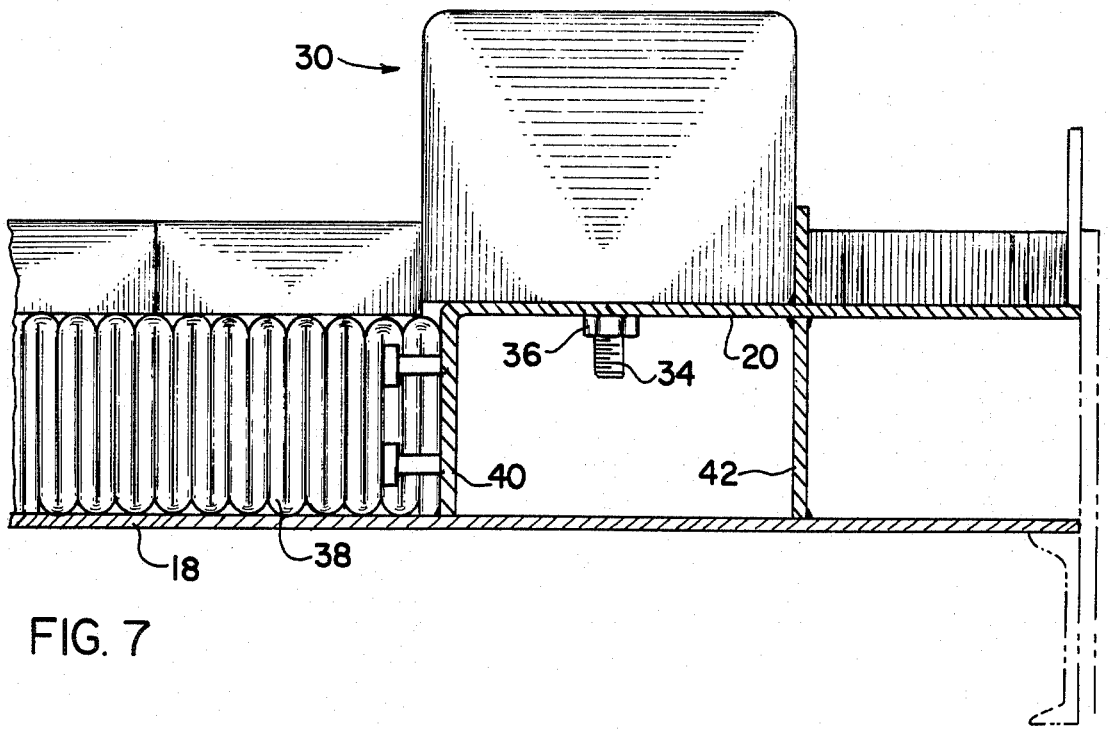

FIGS. 5 and 5*a* are detailed views in section of a portion of the module of FIG. 4 and the arrangement used to attach it to the ladle cover plate;

FIG. 6 is a perspective view of the clip shown in FIG. 5 and used to attach the module of FIG. 4 to the ladle cover plate; and FIG. 7 is a partial sectional view of an alternate embodiment of a ladle cover plate in accordance with the invention.

Broadly, the invention comprises an improved ladle cover plate for use with apparatus for heating a ladle or the like which ladle cover plate has a substantially flat surface covered with heat-insulating refractory material. Means are provided for bringing the ladle cover plate into sealing engagement about the rim of the ladle opening. A ring of refractory modules is removably secured to the surface of the ladle cover plate having the heat insulating refractory material thereon. The ring of modules which is removably secured to said ladle cover plate surface is adapted to effect the sealing engagement with the rim of the ladle. Each refractory module is individually, removably secured to the surface of the cover plate so that upon damage thereof only the damaged module may be efficiently removed and replaced without disturbing the remainder of the modules constituting the ring. Each module may be formed of a plurality of layers of refractory fiber material perpendicular to the ladle rim and parallel to the ladle longitudinal axis. Each module, in accordance with the invention, may be removably secured to the surface of the ladle cover plate by means of a clip attached to a module bottom fixture and a bolt removably securing the clip, fixture, and module to the cover plate.

Figure 1:
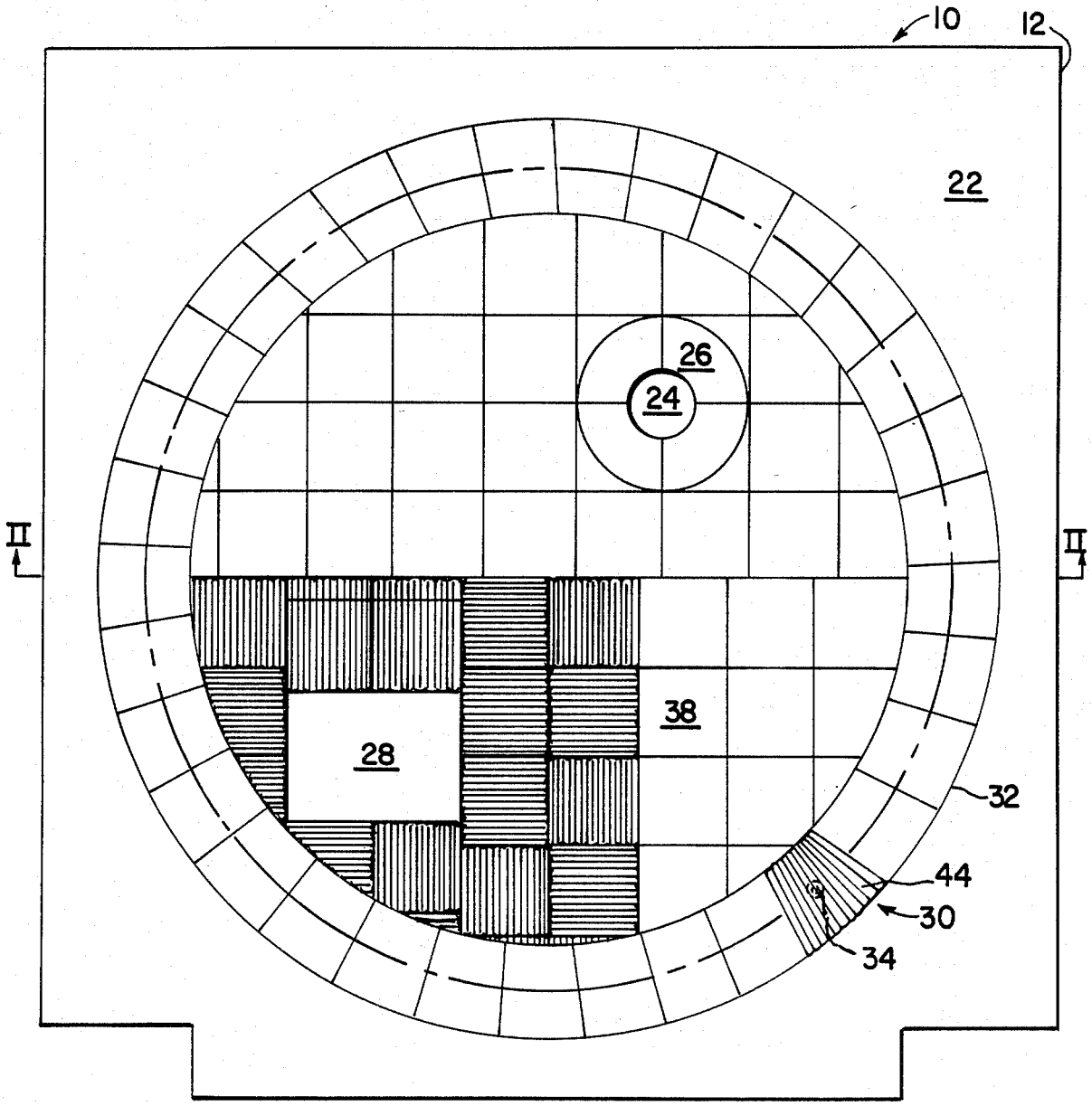
FIG. 1 is a plan view of a ladle cover plate in accordance with the invention.
Figure 2:
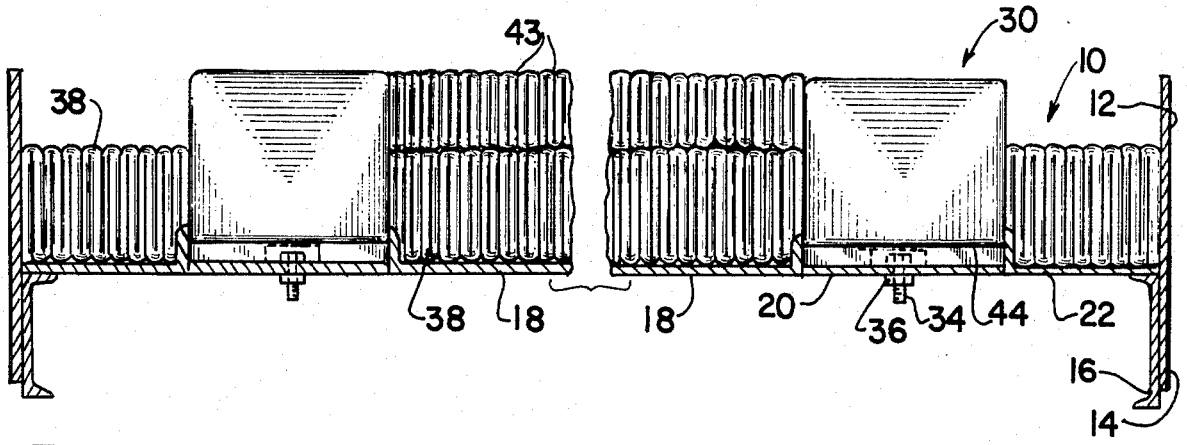
FIG. 2 is a section taken along lines II—II of FIG. 1.
Figure 3:
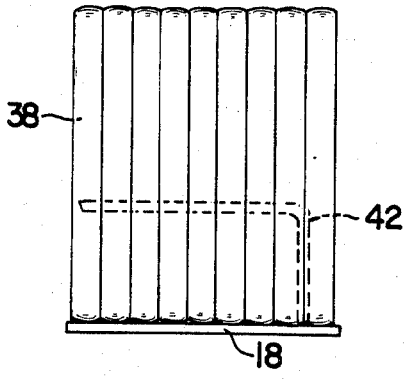
FIG. 3 is a detail elevation of a stackbonded lining incorporated in the ladle cover plate in accordance with the invention.

With reference to the drawings and for the present to FIGS. 1 and 2 thereof, there is shown generally a ladle cover plate designated as 10. The ladle cover plate consists of a frame 12 having a depending portion 14 connected to channels 16. Within the frame 12 is a circular ring 18 that has its periphery attached to the edge of circular channel 20. Between the outer edge of the channel 20 and the frame 12 is a periphery ring plate 22. The plate 18, channel 20 and ring plate 22 constitute the surface of the ladle cover plate to which the refractory material is attached and which is brought into sealing engagement with the rim of the ladle opening during preheating. A circular opening 24 lined with refractory burner block 26 is provided on the surface of the ladle cover plate to accommodate the burner and the hot combustion gases which flow into the ladle interior during preheating in the conventional manner. Likewise a generally rectangular opening 28 is provided in the surface of the ladle cover plate, which opening permits escape of the combustion gases that in the conventional manner may be recirculated through a heat exchanger in a preheating apparatus as described in U.S. Pat. No. 4,229,211. The channel 20 constituting the frame for the ring which is adapted for mating, sealing engagement with the ladle rim is provided with a single row of abutting modules 30, which module is shown in detail in FIG. 4. Each module 30 is constructed from a strip of refractory fiber material **30*b* that is folded in alternating, opposite directions to form a plurality of layers perpendicular to the ladle rim and parallel to the longitudinal axis. The layers are compressed by bands 31 so that the modules are of a trapezoidal configuration required for installation. Each module also has a base fixture 30*a* to which the refractory fiber material 30*b* is attached. Attachment is provided by a clip 30*c*, as shown in FIG. 6 positioned as shown in FIGS. 5 and 5*a* beneath the folds of the refractory fiber material. The clip 30*c* attaches to a fixture 30*a* that consists of a series of rods 30*d* inserted into the folds of the material 30*b*. Each module is removably secured within channel 20 by bolt 34 which extends through the channel 20 and is secured by nut 36. The modules are secured in this manner in abutting relation to adjacent modules to form the ring of refractory modules 32. Each module 30 is so secured in abutting relation and the flexible refractory fiber material permits each module to conform to the circular configuration of the channel 20 thereby facilitating formation of the ring 32. Removal of any damaged module may be readily effected by merely removing the nut from the bolt, lifting out the damaged module and replacing it with another like module. This may be done without disturbing adjacent abutting modules. The remainder of the surface of the ladle cover plate constituting plate 18 and plate 22 are provided with a covering of refractory fiber lining 38 which are shown in detail in FIG. 3. The lining 38 is constructed of stackbonded ceramic fiber strips which are impaled on anchors 42 that are welded to the plate 18 and plate 22. Onto the surface of the lining 38 are cemented additional high-temperature ceramic modules 43 which may also be of similar stackbonded construction as lining 38**.

The resiliency of the module seal can be varied by the use of refractory fiber material of different densities and also by varying the number of layers of fiber material per unit of module width.

During use of the above-described ladle cover plate of the invention in a typical ladle preheating operation, the cover plate would be connected to a mechanism that would bring the ladle cover plate into engagement with the ladle for the preheating operation. A burner, not shown, would be positioned at opening 24 in the ladle cover plate to provide the flame within the ladle during the preheating operation. Exhaust gases would be permitted to escape from the ladle through opening 28 in the ladle cover plate and these exhaust gases would in the conventional manner be introduced to a heat exchanger, not shown. The ring 32 of refractory modules 30 removably secured to the ladle cover plate would mate with the rim of the ladle and provide the required sealing engagement therewith. The modules 30 and lining 38 of refractory material would provide the required heat insulation over the ladle opening so that escape of the heat energy is minimized to render the preheating operation more effective and economical.

An alternate embodiment of a ladle cover plate, as shown in FIG. 7, has modules 30 positioned to extend above the lining 38 of the ladle cover plate. Concentric support rings 40 and 42 onto which circular channel 20 is secured provide for the offset mounting of the modules.

Although the invention has been described for use with hot-metal transport ladles used in metal refining operations, it could also be used in any analogous heating operation of a vessel wherein the rim portion thereof is brought into sealing engagement with a heat-insulating cover and which rim portion for whatever reason causes wear or damage to the refractory material of the cover in engagement therewith.

What is claimed is:

1. An improvement in an apparatus for heating a ladle, said ladle having an opening with a rim about the opening, and said apparatus including a seal assembly for sealing engagement with said rim of said ladle, said seal assembly having a ladle cover plate having a surface covered with heat-insulating refractory material, means for bringing said surface covered with heat-insulating refractory material into sealing engagement with said rim of said ladle and a burner adapted to direct a flame into said ladle when said surface is in sealing engagement with said rim of said ladle, said improvement comprising a ring of refractory modules individually removably secured to said surface of said ladle cover plate independent of said heat-insulating refractory material and formed of a plurality of layers of refractory fiber arranged perpendicular to the ladle rim and parallel to the ladle axis, said ring being adapted to effecting said sealing engagement with said rim of said ladle.

2. The apparatus of claim 1 wherein a strip of refractory fiber is folded in alternating directions to form said plurality of layers.

3. The apparatus of claim 1 wherein said refractory modules are removably secured in abutting relation to form said ring.

4. The apparatus of claim 1 wherein said ring of refractory modules extends beyond the remainder of said heat-insulating refractory material of the ladle cover plate.

5. An improvement in an apparatus for heating a ladle, said ladle having an opening with a rim about the opening, and said apparatus including a seal assembly for sealing engagement with said rim of said ladle, said seal assembly having a ladle cover plate having a surface covered with heat-insulating refractory material, means for bringing said surface covered with heat-insulating refractory material into sealing engagement with said rim of said ladle and a burner adapted to direct a flame into said ladle when said surface is in sealing engagement with said rim of said ladle, said improvement comprising a ring of refractory modules individually removably secured to said surface of said ladle cover plate independent of said heat-insulating refractory material and formed of a plurality of layers of refractory fiber arranged perpendicular to the ladle rim and parallel to the ladle axis, said ring has outer and inner edge portions thereof enclosed in a channel and being adapted for effecting said sealing engagement with said rim of said ladle.

* * * * *